United States Patent [19]

Kondo

[11] 4,323,355

[45] Apr. 6, 1982

[54] SPLASH PLATE FOR MARINE PROPULSION DEVICES

[75] Inventor: Yasuo Kondo, Shizuoka, Japan

[73] Assignee: Yamaha Hatsudoki Kabushiki Kaisha, Iwata, Japan

[21] Appl. No.: 123,281

[22] Filed: Feb. 21, 1980

[30] Foreign Application Priority Data

Mar. 6, 1979 [JP] Japan ..... 54-25960

[51] Int. Cl.[3] ..... B63H 21/26

[52] U.S. Cl. ..... 440/76; 440/900

[58] Field of Search ..... 440/66, 900, 76

[56] References Cited

U.S. PATENT DOCUMENTS

| | | | |
|---|---|---|---|
| 2,690,728 | 10/1954 | Cavanaugh | 440/900 X |
| 2,860,594 | 11/1958 | Kiekhaefer | 440/66 |
| 3,955,527 | 5/1976 | Holtermann | 440/66 |

*Primary Examiner*—Kathleen J. Prunner

*Attorney, Agent, or Firm*—Donald D. Mon

[57] ABSTRACT

A splash plate for the casing of a marine propulsion device, which casing is disposed rearwardly and outside of the hull. The splash plate projects forwardly of the casing, and its lower surface at the forward end is lower than it is at a rear portion so that water splashed by the device is deflected downwardly.

7 Claims, 5 Drawing Figures

SPLASH PLATE FOR MARINE PROPULSION DEVICES

FIELD OF THE INVENTION

This invention relates to marine propulsion devices which have a casing outside a hull and at least partially immersed in the water, for example an outboard motor or an outboard stern-drive unit driven by an inboard engine.

BACKGROUND OF THE INVENTION

In marine propulsion devices disposed outside of the hull, their casing during cruising splashes a mixture of water film and droplets in the upward direction from the surface of the water. In order to prevent the splashed water from impinging upon the upper portion of the casing, a splash plate is provided on the casing so that it extends from the front surface (frontwardly-facing surface) of the casing to the side surfaces of the same, thereby to deflect the upwardly directed splashes of water downwardly.

However, a casing of some cross-sections deflects the splashed water forwardly. Then a conventional splash plate fails sufficiently to prevent a violent frontward deflection of splashes. As a result, splashes of water are scattered upwardly in the frontward direction, onto the stern, and thereafter are scattered upwardly. The splashed water then can enter the interior of the hull or fall onto the engine or onto electric parts in the engine cowling.

In order to obviate the above-explained drawback of the prior art, it has been proposed to increase the length of the frontwardly projected portion of the splash plate. However, there is a practical limit to the length of the forwardly projected portion of a splash plate, because it is necessary to avoid mutual interference between the splash plate and the stern of the boat, and to meet the requirements for strength and size.

An object of the present invention is to provide a splash plate for marine propulsion devices, which can reliably prevent the splashes of water from scattering in the upward direction, and without increasing the length of the forward projection of the splash plate.

BRIEF DESCRIPTION OF THE INVENTION

To this end, according to the present invention, there is provided a marine propulsion device having a splash plate on the front surface of a casing, the splash plate preferably extending from the front surface to side surfaces of the casing and positioned above the water surface during normal cruising, thereby to deflect splashes of water downwardly, the lower surface of the splash plate being inclined such that the lower surface of a front end portion of the splash plate is lower than that of a rear end portion of the same. According to a marine propulsion device of the above-described construction of the present invention, the splashes of water deflected frontwardly by the front surface of a casing are further deflected downwardly by the inclined lower surface of a front portion of a splash plate. As a result, the scattering in the upward direction of water can be completely suppressed.

The invention will be more fully understood from the following description of the preferred embodiment taken in conjunction with the accompanying drawings, in which:

DETAILED DESCRIPTION OF THE INVENTION

Figure 1:
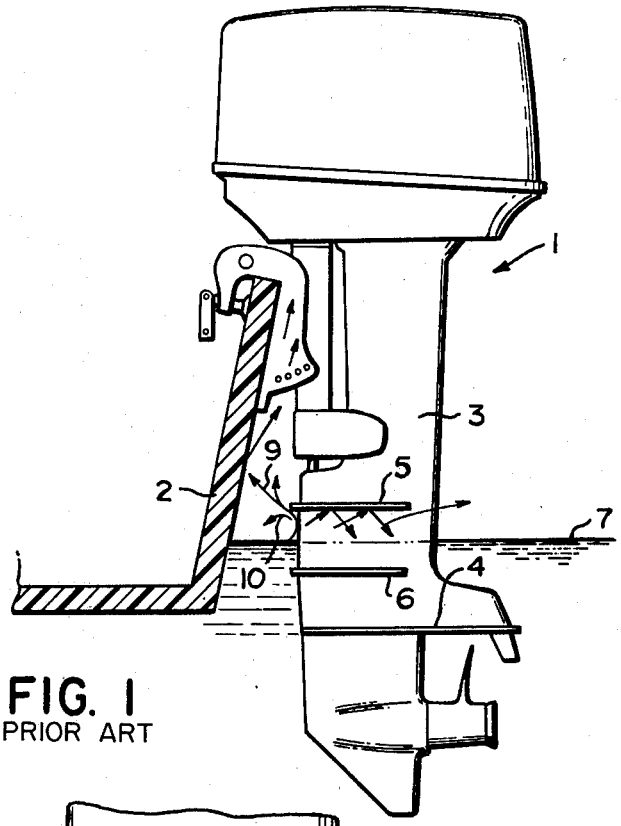
FIG. 1 PRIOR ART
FIG. 1 is a side elevational view of an example of an outboard motor to which a splash plate is applied.
Figure 2:
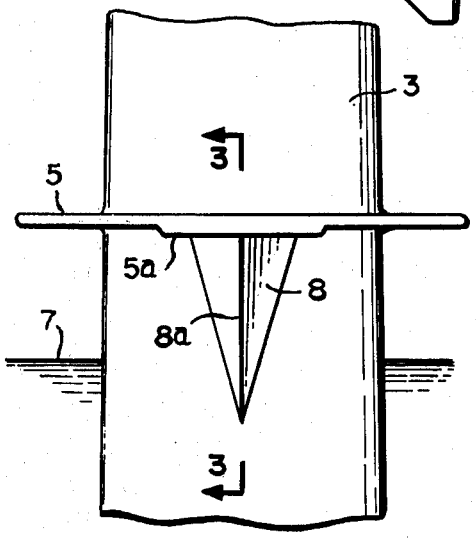
FIG. 2 is a front elevational view of an example of a splash plate according to the present invention.
Figure 3:
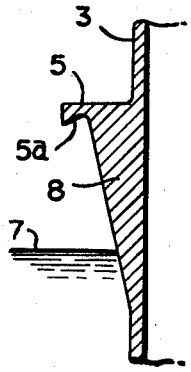
FIG. 3 is a vertical sectional view of the splash plate shown in FIG. 2, taken at line 3—3 in FIG. 2.

Referring to FIG. 1, an outboard motor 1 has a casing 3 fixed to the stern 2 of a hull such that the casing 3 can be swung in the horizontal plane. An anticavitation plate 4 is provided at a lower portion of the casing 3, and conventional splash plates 5, 6 are provided above the anti-cavitation plate 4. At least the uppermost splash plate 5 is positioned above the surface 7 of water during normal cruising. An example of the uppermost splash plate 5 according to this invention is shown in FIGS. 2 and 3.

A downwardly converged cutwater 8 is formed on that portion of the front surface of the casing 3 which is under the splash plate 5, such that a ridge 8*a* of the cutwater 8 is directed forwardly. The splash plate 5 has a flat upper surface, while the lower surface 5*a* of a front portion of the splash plate 5 is inclined such that the lower surface of the front end portion is lower than that of the rear end portion thereof. This cutwater 8 serves to decrease the amount of splashes of water deflected in the frontward direction, although it is not essential.

On the other hand, the lower splash plate 6 may be formed in the same manner as the upper splash plate 5 since the lower splash plate 6 comes to be positioned above the surface of water when the vessel begins to run at a high speed in a planing state.

Figure 4:
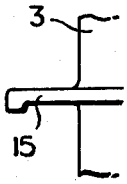
FIG. 4 is a partial side elevational view of another embodiment of the present invention.
Figure 5:
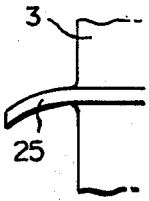
FIG. 5 is a partial side elevational view of still another embodiment of the present invention.

FIGS. 4 and 5 show different forms of the splash plate according to the invention. Splash plate 15 shown in FIG. 4 is downwardly bent at the front end portion thereof. Splash plate 25 shown in FIG. 5 is gradually bent in the downward direction at the front end portion thereof as a whole.

Since the lower surface of a splash plate according to the present invention is inclined such that the lower surface of a front end portion thereof is lower than that of a rear portion, the water deflected by the front surface of a casing and then impinging upon the splash plate is naturally directed downwardly so that the water can be prevented from scattering in the upward direction.

Supposing that a splash plate having no such an inclined lower surface is used, as illustrated in FIG. 1, then splashes of water will be violently deflected by the casing and will undesirably scatter in the upward direction as shown by arrows 9 in FIG. 1. However, when the present invention is utilized, such splashes of water are effectively deflected downwardly as shown by arrows 10 in FIG. 1 so that the undesirable upward scattering of the water splash is fairly avoided.

The lower surface of a front end portion of the splash plate may be cross-sectionally arcuate or gently curved or linear, and the inclination may start at any portion of the splash plate.

This invention is not to be limited by the embodiments shown in the drawing and described in the description, which are given by way of example and not of limitation, but only in accordance with the scope of the appended claims.

I claim:

1. In combination with a marine propulsion device for mounting to a boat hull rearwardly and outboard thereof, and having a casing intended to be at least partially immersed in water through which water the hull is to be forwardly propelled, a splash plate mounted to said casing and projecting forwardly from said casing at an elevation such that it will be positioned above the water surface during normal cruising, said splash plate having a lower surface to deflect water splashed by the casing, said lower surface being shaped so that a forward portion thereof is lower than a rear portion thereof.

2. A combination according to claim 1 in which the said forward portion is inclined.

3. A combination according to claim 2 in which the said splash plate is downwardly bent at said forward portion.

4. A combination according to claim 1 in which the said forward portion includes a downwardly projecting lip.

5. A combination according to claim 1 in which a cutwater is mounted to the front of the casing directly beneath said splash plate.

6. A combination according to claim 5 in which the said forward portion is inclined.

7. A combination according to claim 5 in which the said forward portion includes a downwardly projecting lip.

* * * * *